US008381706B2

(12) United States Patent
Akiyama et al.

(10) Patent No.: US 8,381,706 B2
(45) Date of Patent: Feb. 26, 2013

(54) HEAD COVER OF AN INTERNAL COMBUSTION ENGINE

(75) Inventors: Yoshihiro Akiyama, Wako (JP); Atsushi Yoshimura, Wako (JP); Isao Emi, Tokyo (JP)

(73) Assignees: Honda Motor Co., Ltd., Tokyo (JP); Mahle Filter Systems Japan Corporation, Tokyo (JP)

( * ) Notice: Subject to any disclaimer, the term of this patent is extended or adjusted under 35 U.S.C. 154(b) by 474 days.

(21) Appl. No.: 12/530,752

(22) PCT Filed: Apr. 30, 2008

(86) PCT No.: PCT/JP2008/001122

§ 371 (c)(1),
(2), (4) Date: Jan. 27, 2010

(87) PCT Pub. No.: WO2008/139719

PCT Pub. Date: Nov. 20, 2008

(65) Prior Publication Data

US 2010/0147273 A1 Jun. 17, 2010

(30) Foreign Application Priority Data

May 16, 2007 (JP) ..... 2007-130263

(51) Int. Cl.
*F02B 25/06* (2006.01)

(52) U.S. Cl. ..... 123/572; 123/573; 123/574; 123/195 C; 123/90.38

(58) Field of Classification Search ..... 123/572–574, 123/90.38, 195 C
See application file for complete search history.

(56) References Cited

U.S. PATENT DOCUMENTS

| | | | | |
|---|---|---|---|---|
| 4,721,090 | A * | 1/1988 | Kato | 123/572 |
| 4,993,375 | A * | 2/1991 | Akihiko | 123/90.38 |
| 5,803,034 | A * | 9/1998 | Gruber et al. | 123/90.38 |
| 6,257,188 | B1 * | 7/2001 | Fujii et al. | 123/90.38 |
| 6,443,136 | B1 * | 9/2002 | Suganami et al. | 123/572 |
| 2004/0187829 | A1 * | 9/2004 | Tohyama | 123/184.57 |
| 2006/0207527 | A1 * | 9/2006 | Saeki et al. | 123/54.4 |
| 2007/0113817 | A1 * | 5/2007 | Awata | 123/184.57 |
| 2009/0038579 | A1 * | 2/2009 | Shieh et al. | 123/195 C |

FOREIGN PATENT DOCUMENTS

| | | | |
|---|---|---|---|
| JP | 7042527 | A | 2/1995 |
| JP | 7127523 | A | 5/1995 |
| JP | 2002070521 | A | 3/2002 |
| JP | 2005155475 | A | 6/2005 |

* cited by examiner

*Primary Examiner* — Nathaniel Wiehe
*Assistant Examiner* — James Kim
(74) *Attorney, Agent, or Firm* — Arent Fox LLP

(57) ABSTRACT

A part of a ceiling wall (14) of a head cover (10) that opposes an intake collection chamber (51) is constituted by a concave ceiling wall (20) that defines a concave surface facing the intake collection chamber (51), and the concave ceiling wall (20) is formed with a recessed groove (21) that further recedes toward an inner side of the head cover.

7 Claims, 5 Drawing Sheets

HEAD COVER OF AN INTERNAL COMBUSTION ENGINE

TECHNICAL FIELD

The present invention relates to a head cover of an internal combustion engine, and particularly relates to a head cover in which a breather chamber of a blow-by gas is defined on an inner side of a ceiling wall of the head cover.

BACKGROUND ART

A head cover attached to a cylinder head of an internal combustion engine to cover a valve mechanism is sometimes formed with a breather chamber (breather passage) on an inner side thereof such that a blow-by gas flows through the breather chamber in order to have an oil mist contained in the blow-by gas be separated from the blow-by gas (gas-liquid separation) (see Japanese Patent Application Laid-Open Publication No. 2005-155475, for example).

For the purpose of achieving a compact arrangement of an intake system of the internal combustion engine, an intake collection chamber of an intake manifold or a surge tank may be disposed close to an upper side of the head cover. In such a case, in order to cope with the requirements for a design change or volume increase of the intake collection chamber, it is demanded to reduce the height of the head cover and hence minimize the height of the breather chamber (passage) defined on the inner side of the head cover.

It should be noted in this regard that if the volume of the breather chamber were insufficient, the performance of the breather chamber to remove oil mist would decrease, and therefore, it is necessary to ensure an adequate volume of the breather chamber while maintaining a small height of the breather chamber in order to cope with the design change or volume increase of the intake collection chamber as well as achieve favorable oil mist removing function. This can be achieved by increasing the size of the breather chamber of the head cover in a lateral direction (in a horizontal direction perpendicular to a crankshaft direction of a longitudinal engine).

However, the size increase of the breather chamber of the head cover in the lateral direction can lead to a ceiling wall of the head cover having a large flat surface, and this can reduce a panel rigidity of the ceiling wall, which in turn makes the ceiling wall easier to resonate with vibrations generated by the valve mechanism and the like on the engine main body side, and thus deteriorates the performance regarding the vibration and noise phenomena (NVH performance).

BRIEF SUMMARY OF THE INVENTION

An object to be achieved by the present invention is to provide a simple modification of the head cover structure that can cope with the design change and volume increase of the intake collection chamber of the engine intake system disposed above the head cover, while ensuring a sufficient volume of the breather chamber without deteriorating the NVH performance.

In order to achieve the above object, the present invention provides a head cover of an internal combustion engine, comprising a ceiling wall, wherein an intake collection chamber of an engine intake system is disposed on an outer side of the ceiling wall and a breather chamber of a blow-by gas is defined on an inner side of the ceiling wall, wherein a part of the ceiling wall that opposes the intake collection chamber is constituted by a concave ceiling wall having a concave surface facing the intake collection chamber, and the concave ceiling wall is formed with a recess that recedes toward an inner side of the head cover.

In the head cover of an internal combustion engine according to the present invention, preferably, a shape of the concave surface of the concave ceiling wall 20 is designed so as to extend substantially along an outer profile of the intake collection chamber that opposes the concave ceiling wall.

In the head cover of an internal combustion engine according to the present invention, the recess is preferably formed at a lowermost part of the concave surface of the concave ceiling wall.

In the head cover of an internal combustion engine according to the present invention, the recess preferably comprises at least one recessed groove that extends in a direction along a crankshaft of the internal combustion engine.

In the head cover of an internal combustion engine according to the present invention, preferably, the ceiling wall is formed with a boss portion which defines an oil inlet and to which an oil filler cap can be detachably attached, and an oil trap portion that surrounds the boss portion and has a part formed with an oil discharge opening, wherein the recessed groove is connected to the oil trap portion at one end of the recessed groove.

The head cover of an internal combustion engine according to the present invention is preferably provided with grid-shaped ribs formed on an inner surface of the concave ceiling wall.

In the head cover of an internal combustion engine according to the present invention, because the part of the ceiling wall that opposes the intake collection chamber is constituted by a concave ceiling wall that defines a concave surface facing the intake collection chamber, it is possible to reduce the height of the head cover so that the head cover does not interfere with the intake collection chamber, while achieving a necessary volume of the breather chamber. Further, because the concave ceiling wall is formed with a recessed groove that further recedes toward the inner side of the head cover, it is possible to improve the panel rigidity of the concave ceiling wall and prevent deterioration of NVH performance.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
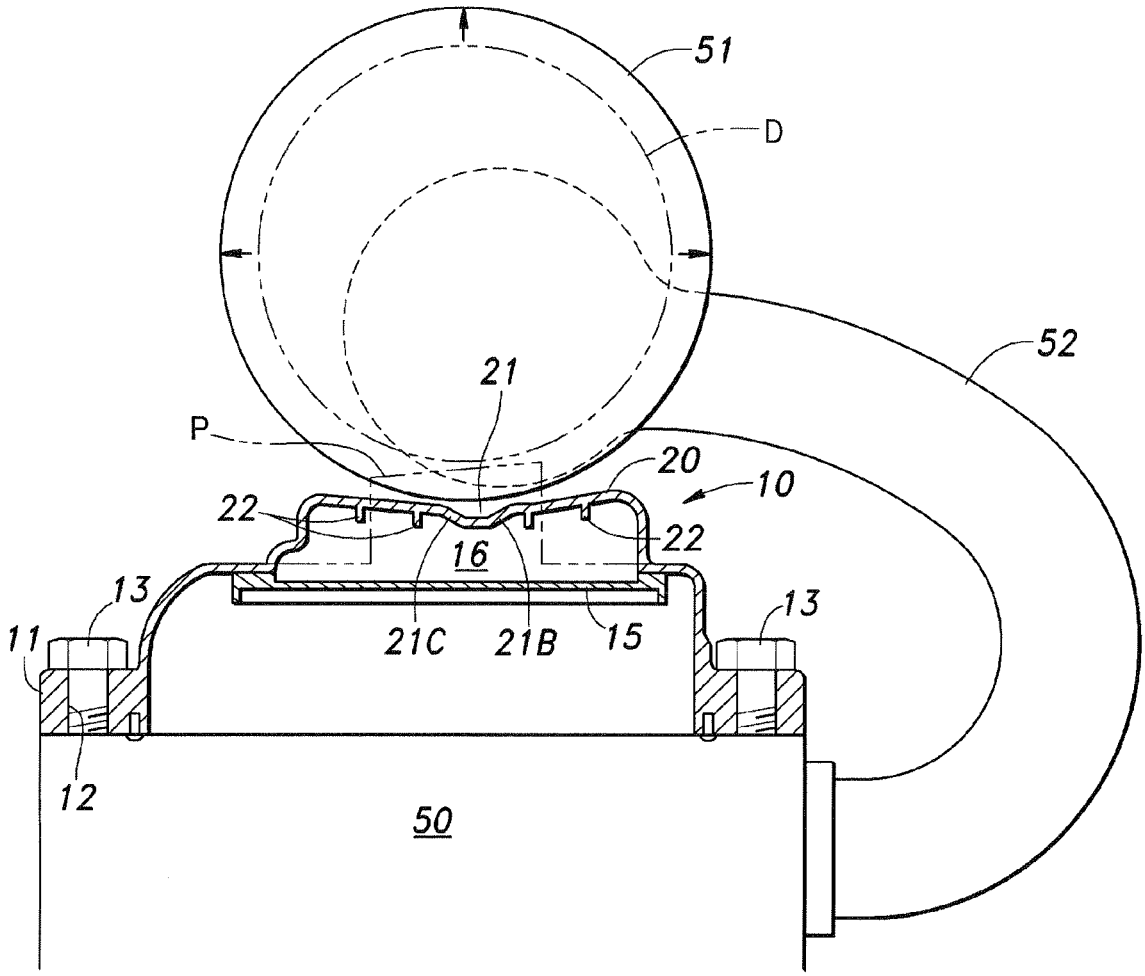
FIG. 1 is a longitudinal cross-sectional view showing an embodiment of a head cover of an internal combustion engine according to the present invention.
Figure 2:
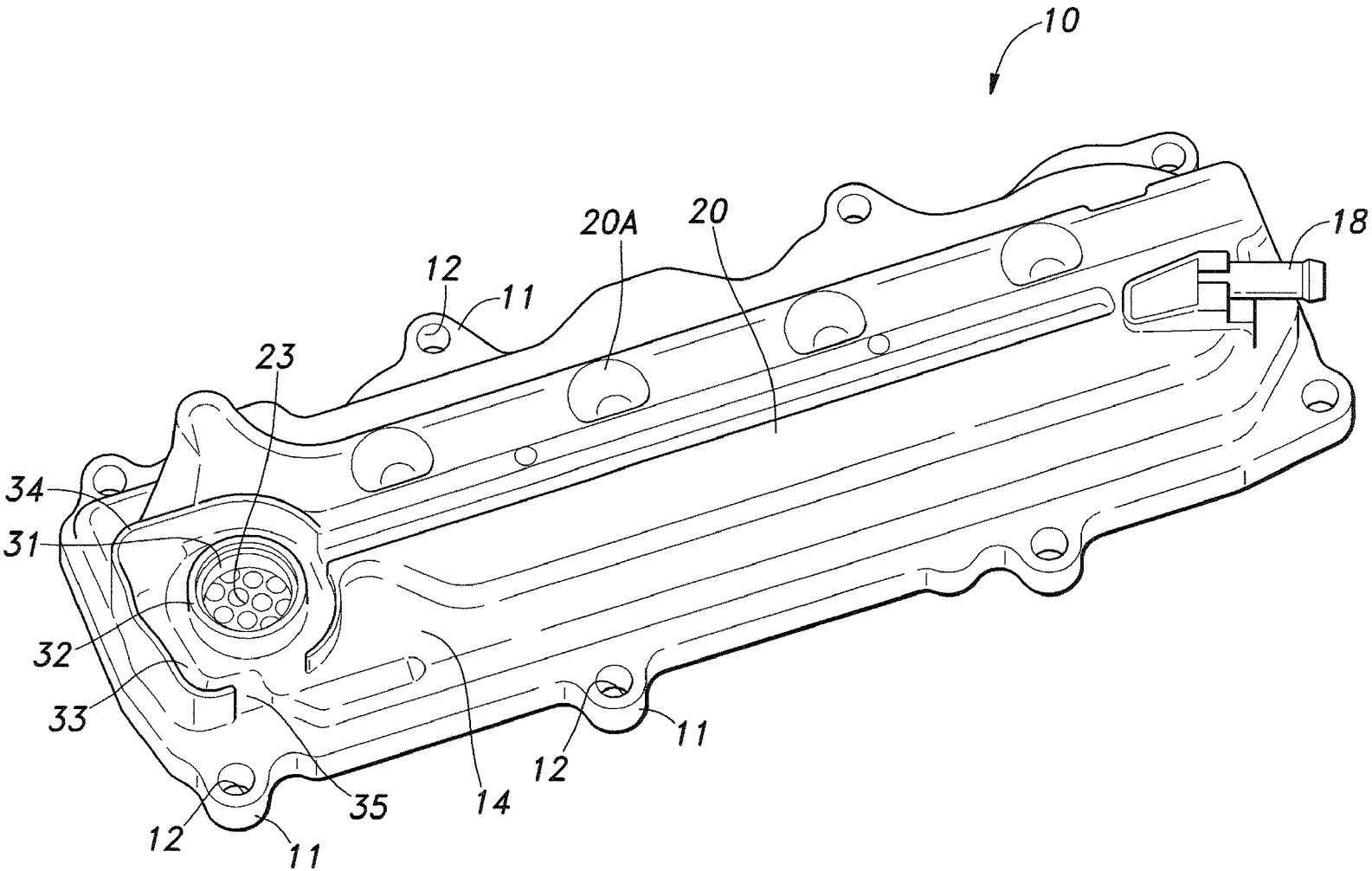
FIG. 2 is a perspective view showing an embodiment of a head cover of an internal combustion engine according to the present invention.
Figure 3:
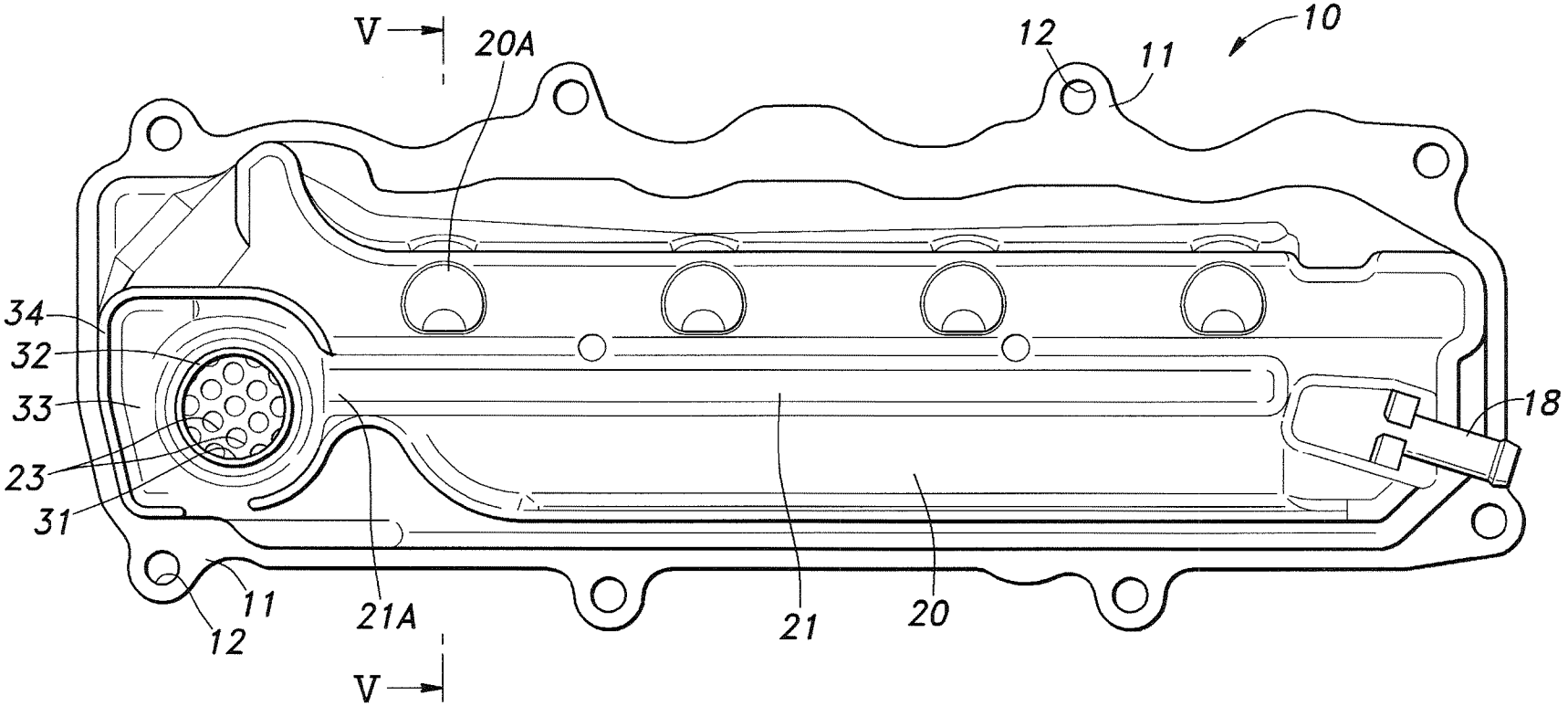
FIG. 3 is a plan view showing an embodiment of a head cover of an internal combustion engine according to the present invention.
Figure 4:
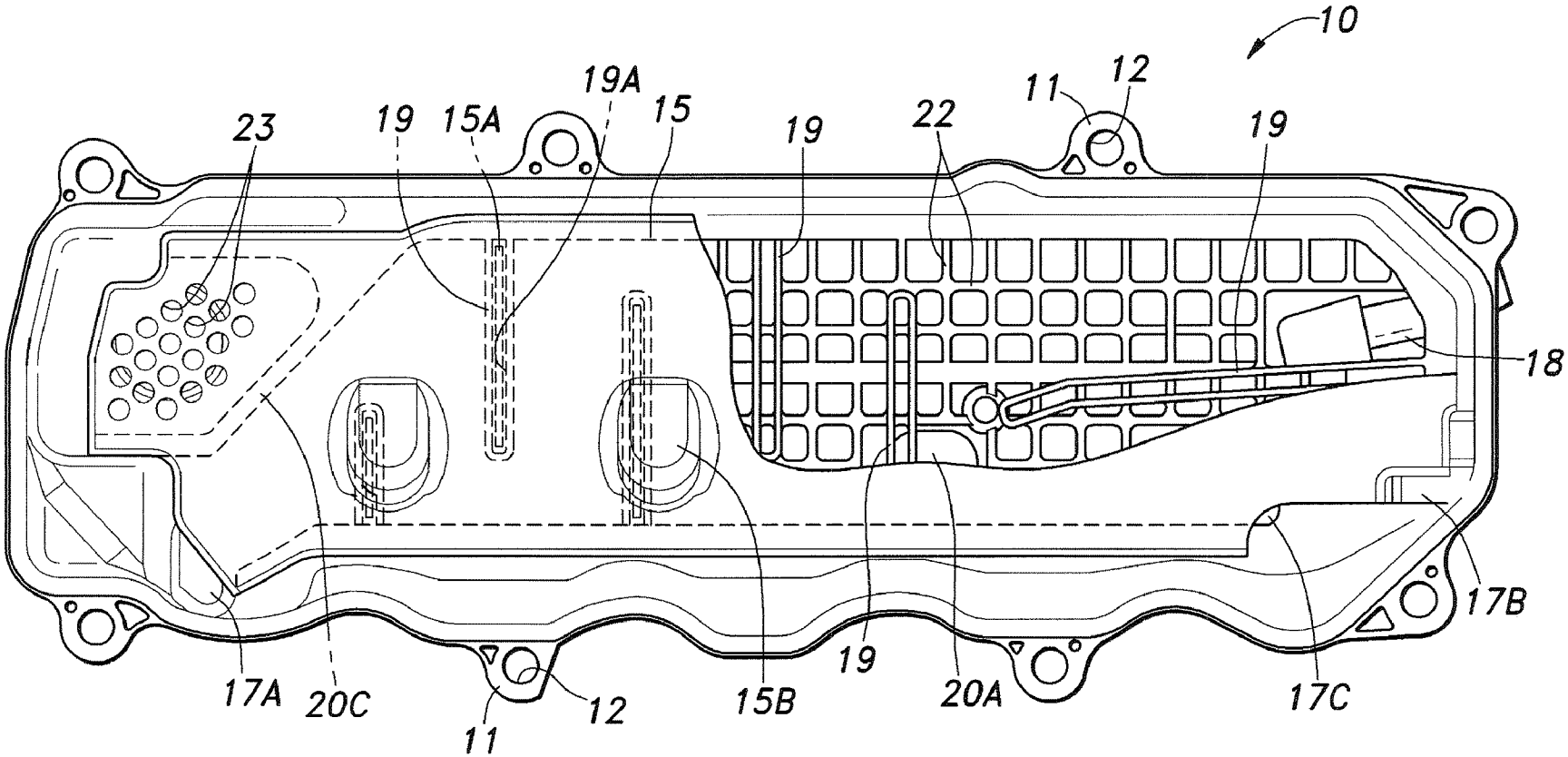
FIG. 4 is a bottom view showing an embodiment of a head cover of an internal combustion engine according to the present invention.

Now, a preferred embodiment of a head cover according to the present invention will be described hereinafter with reference to FIGS. 1-5.

A head cover 10 according to this embodiment is used in a straight four-cylinder engine, and consists of a lid-like member extending in the direction of cylinder arrangement and made by molding a resin material such as glass-fiber reinforced polyamide resin. The head cover 10 is securely fastened to an upper surface of a cylinder head 50 by means of fastening bolts 13 passed through corresponding through holes 12 defined in bolt boss portions 11 which are formed at a plurality of locations along an outer periphery of the head cover 10.

An intake collection chamber (surge tank) 51 of an engine intake system is disposed close to an outer surface of a ceiling wall 14 of the head cover 10. The intake collection chamber 51 of the engine intake system herein includes an intake collection chamber of an intake manifold and a surge tank. In FIG. 1, a reference numeral 52 indicates intake branch pipes for distributing the intake air from the intake collection chamber 51 to each of the cylinders (not shown in the drawing) of the internal combustion engine.

In a portion of the ceiling wall 14 of the head cover 10, specifically, in a vicinity of one end of the ceiling wall 14 in a direction of cylinder arrangement, a boss portion 32 defining an oil inlet 31 and an oil trap portion 33 surrounding the boss portion 32 are formed, where the boss portion 32 is adapted such that an oil filler cap can be detachably attached to the boss portion 32. An outer boundary of the oil trap portion 33 is defined by an oil outflow prevention wall 34 extending upright from the ceiling wall 14. A part of the oil outflow prevention wall 34 is broken to form an oil discharge opening 35. The oil discharge opening 35 opens toward one lateral direction (right in FIG. 1) with respect to the direction of cylinder arrangement so that the oil would not splash on a driving belt disposed on a frontal side of the engine.

Attached to an inner side of the ceiling wall 14 of the head cover 10 (specifically, on an inner side of a later-described concave ceiling wall 20) is a breather chamber partition plate 15. The head cover 10 defines a breather chamber 16 between the ceiling wall 14 and the breather chamber partition plate 15. The breather chamber 16 constitutes a passage space that may be also referred to as an oil separator chamber, and has a rectangular cross-section that is elongated in a lateral direction (left and right direction in FIG. 1) to achieve a sufficient inner volume of the breather chamber 16 while maintaining a small passage height (chamber height) of the breather chamber 16.

Figure 5:
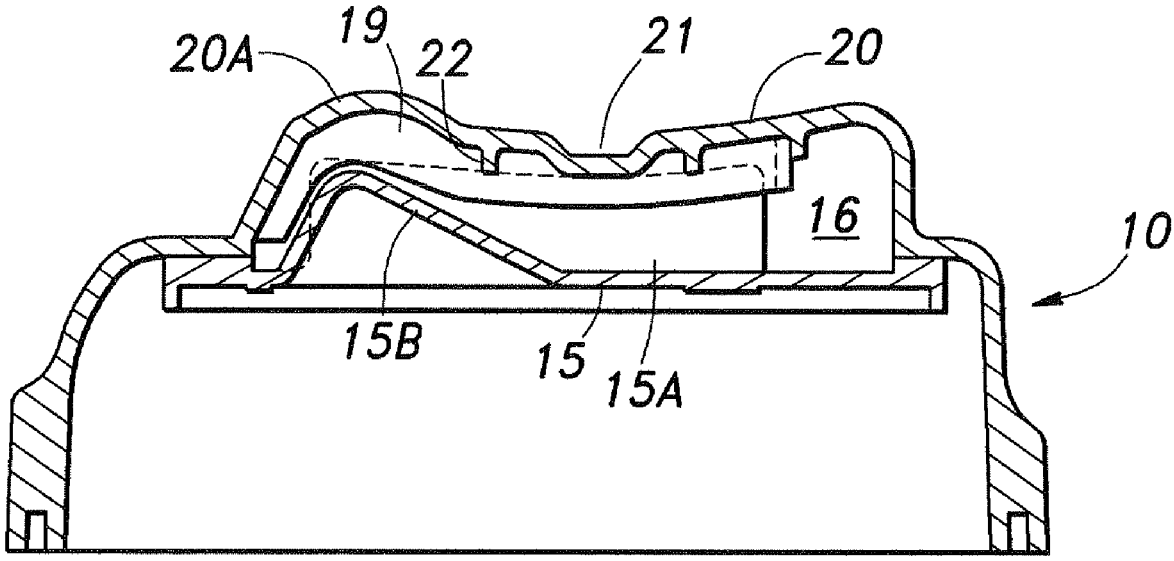
FIG. 5 is an enlarged longitudinal cross-sectional view taken along the line V-V in FIG. 3 showing a head cover of an internal combustion engine according to the present invention.

The passage height of the breather chamber 16 is designed to increase in both lateral directions from a lateral center of the breather chamber 16, and this contributes to ensuring a sufficient inner volume of the breather chamber 16 and suppressing the flow resistance of the blow-by gas. As shown in FIG. 5, the breather chamber partition plate 15 is formed with a plurality of relief portions 15B corresponding to the number of the cylinders in order to avoid interfering with the valve mechanism (not shown in the drawings) mounted on the cylinder head 50. The relief portions 15B are formed by depressing prescribed portions of the breather chamber partition plate 15 that oppose the valve mechanism toward the breather chamber 16. Thus, the relief portions 15B protrude into the breather chamber 16. In this connection, the ceiling wall 14 of the head cover 10 is formed with relief portions 20A at portions aligned with the relief portions 15B to avoid interference with the relief portions 15B. The relief portions 20A each have a generally semi-spherical shape, and are concave on the inner side of the ceiling wall 14 (or when seen from the breather chamber 16 side) and convex on the outer side of the ceiling wall 14.

A number of small oil passage holes 23 are formed in a portion of the breather chamber partition plate 15 aligned with the oil inlet 31.

The blow-by gas enters the breather chamber 16 from blow-by gas inlets 17A, 17B that open on the inner side of the head cover 10, and the blow-by gas flows through the breather chamber 16 to be discharged to an outside of the breather chamber 16 through a blow-by gas outlet port 18 formed in the head cover 10. While the blow-by gas flows through the breather chamber 16, the oil component such as oil mist contained in the blow-by gas is separated and removed from the blow-by gas. The oil separated in the breather chamber 16 drops to the cylinder head 50 via an oil drain 17C and the blow-by gas inlet 17A, and is recovered. The blow-by gas inlet 17A serves both as a blow-by gas inlet and as an oil drain.

It should be noted that a space defined between the oil inlet 31 and the oil through holes 23 is separated from the breather chamber 16 by a partition wall 20C.

In order to enhance the oil mist separating ability of the breather chamber 16, a plurality of baffle walls 19 are formed alternately on the inner surface of the ceiling wall 14. Each baffle wall 19 has a double wall structure comprising a pair of walls, between which a recessed groove 19A opening toward the breather chamber partition plate 15 is defined. On portions of the breather chamber partition plate 15 that oppose the baffle walls 19, baffle walls 15A are protrudingly formed. The baffle walls 15A protrude into the corresponding recessed grooves 19A and, in cooperation with the baffle walls 19, form a labyrinth-like structure within the breather chamber 16.

It should be noted that the baffle wall 15A opposing the relief portion 20A is formed on the associated relief portion 15B, and the baffle wall 19 opposing the relief portion 15B is formed on the associated relief portion 20A. The baffle wall 19 formed on the relief portion 20A is provided with such a shape that can avoid interference with the associated relief portion 15B (see FIG. 5).

The above baffle walls 19, 15A form a labyrinth-like blow-by gas passage in the breather chamber 16, thereby increasing the travel distance of the blow-by gas within the breather chamber 16. This can improve the oil mist separation effect of the breather chamber 16.

As described above, the breather chamber 16 is defined on the inner side of the portion of the ceiling wall 14 of the head cover 10 that opposes the intake collection chamber 51, and the cross-section of the breather chamber 16 has a shape elongated in the lateral direction (left and right direction in FIG. 1) in order to ensure a sufficient inner volume of the breather chamber 16 while maintaining a small passage height of the breather chamber 16.

The portion of the ceiling wall 14 opposing the intake collection chamber 51 is constituted by a concave ceiling wall 20 that defines a concave surface facing the intake collection chamber 51. The shape of the concave surface of the concave ceiling wall 20 is designed so as to extend substantially along an outer profile of the intake collection chamber 51 opposing the concave ceiling wall 20. In this embodiment, the intake collection chamber 51 has a cylindrical outer profile (i.e., circular lateral cross-section), and thus the concave shape of the concave ceiling wall 20 is constituted by an arcuate surface extending substantially along the cylindrical outer profile of the intake collection chamber 51.

The cylindrical outer profile (circular lateral cross-section) of the intake collection chamber 51 contributes to a higher rigidity of the intake collection chamber 51. With the concave ceiling wall 20, the head cover 10 of the present embodiment can easily cope with the intake collection chamber 51 having the cylindrical outer profile and with high rigidity. It should be mentioned that the lateral cross-section of the intake collection chamber 51 may not be limited to a circle, but may be a substantially circular shape such as an ellipse or an oblong circle. In the cases that the intake collection chamber 51 has a substantially circular lateral cross section also, the intake collection chamber 51 can assume a high rigidity, and the head cover of the present invention can easily cope with such an intake collection chamber 51.

The concave ceiling wall 20 is further formed with a recessed groove 21 serving as a recess that recedes toward the inner side of the head cover 10. The recessed groove 21 consists of a narrow recessed groove extending in the crankshaft direction of the internal combustion engine (left and right direction in FIGS. 2 and 3) or in the direction of cylinder arrangement at a lowermost portion of the concave surface of the concave ceiling wall 20 (i.e., at a position at which the concave ceiling wall 20 is laterally divided into halves). The recessed groove 21 is connected to the oil trap portion 33 at its one end 21A in the cylinder arrangement direction. It should be noted that the oil outflow prevention wall 34 is partly broken at a position between the oil trap portion 33 and the recessed groove 21 so that the recessed groove 21 is connected to the oil trap portion 33.

Further, a grid-shaped ribs 22 are integrally molded (formed) on a substantially entire part of the inner surface of the concave ceiling wall 20.

As described above, because the part of the ceiling wall 14 of the head cover 10 opposing the intake collection chamber 51 is constituted by the concave ceiling wall 20, this part of the ceiling wall 14 (i.e., the concave ceiling wall 20) can assume a rigidity comparable to that of a circular pipe, and thus is less likely to undergo panel resonance due to vibrations generated by the valve mechanism or the like on the engine main body side.

Further, because the narrow recessed groove 21 extending along the cylinder arrangement direction is formed at the lowermost portion of the concave surface of the concave ceiling wall 20, an area of the concave ceiling wall 20 that could undergo panel resonance is reduced, and side walls 21B, 21C of the recessed groove 21 can serve as reinforcing ribs. These can contribute to making the concave ceiling wall 20 less likely to undergo panel resonance.

Further, because the grid-shaped ribs 22 are formed over a substantially entire part of the inner surface of the concave ceiling wall 20, the area of the concave ceiling wall that could undergo panel resonance can be reduced even further, and this makes it even harder for the concave ceiling wall 20 to undergo panel resonance.

Still further, the concave ceiling wall 20 is formed with the substantially semi-spherical relief portions 20A at a plurality of longitudinal positions on the head cover 10 (in this embodiment, four positions corresponding to the number of the engine cylinders), and this also increases the panel rigidity of the concave ceiling wall 20 and thus contributes to preventing panel resonance of the ceiling wall 20. Further, each relief portion 20A forms a recess in the breather chamber 16, thus contributing to ensure a sufficient inner volume of the breather chamber 16.

Owing to the above features, the panel rigidity of the ceiling wall 14 of the head cover 10 is improved, and it is possible to ensure a sufficient volume of the breather chamber 16 and achieve a satisfactory NVH performance while coping with a design change or volume increase of the intake collection chamber 51 of the engine intake system disposed above the head cover 10.

Because the recessed groove 21 is connected to the oil trap portion 33 formed around the boss portion 32 that defines the oil inlet 31, the rainwater or muddy splashes accumulated in the recessed groove 21 will flow to the oil trap portion 33 and be readily discharged from the oil discharge opening 35 to the outside of the head cover 10.

Therefore, it is possible to prevent the rainwater or muddy splashes from staying in the recessed groove 21, and thus avoid deterioration of the head cover 10 made of resin due to chemical components or the like contained in the rainwater or muddy splashes.

The beneficial effects of the present embodiment can be summarized as follows:

(1) Because the part of the ceiling wall of the breather chamber 16 that corresponds to the intake collection chamber 51 is constituted by the concave ceiling wall 20, it is possible to reduce the height of the head cover 10 so that the head cover does not interfere with the intake collection chamber 51, while achieving a necessary volume of the breather chamber 16. Further, because the concave ceiling wall 20 is formed with the recessed groove 21 that further recedes toward the inner side of the head cover 10, it is possible to improve the panel rigidity of the concave ceiling wall 20 and prevent deterioration of NVH performance.

If the ceiling wall of the head cover 10 has a shape as shown by phantom line P in FIG. 1, the ceiling wall could have a high rigidity, but in order to avoid interference, the intake collection chamber 51 would have to be made smaller as shown by phantom line D in FIG. 1. However, according to the present embodiment, it requires only a simple design change of the head cover 10 as described above to ensure a sufficient volume of the breather chamber 16 and achieve a satisfactory NVH performance while coping with a design change or volume increase of the intake collection chamber 51 of the engine intake system disposed above the head cover.

(2) By adapting the concave surface of the concave ceiling wall 20 so as to extend substantially along the outer profile of the intake collection chamber 51 that opposes the concave ceiling wall 20, it is possible to prevent interference between the ceiling wall and the intake collection chamber 51 while ensuring a sufficient breather chamber volume.

(3) By forming a recessed groove 21 at the lowermost portion of the concave ceiling wall 20, an area of the ceiling surface (vibration surface) can be evenly reduced by the recessed groove 21, and therefore an anti-vibration and noise performance can be improved.

(4) If the recessed groove 21 consists of a recessed groove extending substantially in the crankshaft direction, the ceiling surface is divided along the crankshaft direction which is a longitudinal direction of the head cover 10. As a result, the area of vibration surface can be considerably reduced and this improves the anti-vibration and noise performance.

(5) By connecting the recessed groove 21 to the oil trap portion 33 formed around the oil inlet boss portion 32, it is possible to discharge the water or the like in the recessed groove 21 from the oil discharge opening 35 to an exterior of the head cover 10, and prevent early deterioration of the head cover 10 made of resin.

(6) When the grid-shaped ribs 22 are formed on the inner side of the concave ceiling wall 20, the ribs 22 and the recessed groove 21 partition the concave ceiling wall 20 (or vibration surface) into parts, and this reduces the area of the vibration surface to thereby improve the anti-vibration and noise performance.

It should be mentioned that the recessed groove 21 does not necessarily extend along the crankshaft direction, but may extend in a direction perpendicular to the crankshaft direction. Further, the recessed groove 21 does not have to be continuous in the crankshaft direction but may comprise a plurality of discrete recesses. The recess or recessed groove may not be provided at the lowermost position of the concave ceiling wall 20 and a plurality of recesses or recessed grooves may be formed in the concave ceiling wall 20. The concave shape of the concave ceiling wall 20 is not limited to an arcuate shape but may be of V-shape formed by inclined surfaces.

The disclosure of the original Japanese patent application (Japanese Patent Application No. 2007-130263 filed on May 16, 2007) on which the Paris Convention priority claim is made for the present application is hereby incorporated by reference in its entirety.

The invention claimed is:

1. A head cover of an internal combustion engine, the engine including an intake system with an intake collection chamber, the head cover comprising a ceiling wall, wherein an outer side of the ceiling wall is adapted to be adjacent the intake collection chamber and a breather chamber of a blow-by gas is defined on an inner side of the ceiling wall, wherein a part of the ceiling wall proximal to the intake collection chamber is constituted by a concave ceiling wall having a concave surface, and the concave ceiling wall is formed with a recessed groove that extends in a longitudinal direction and recedes toward an inner side of the head cover, and the breather chamber has a rectangular cross-section elongated in a lateral direction and has a passage height that increases in both lateral directions from a lateral center of the chamber.

2. The head cover according to claim 1, where a shape of the concave surface of the concave ceiling wall is designed so as to extend substantially along an outer profile of the intake collection chamber that opposes the concave ceiling wall.

3. The head cover according to claim 2, wherein the recessed groove is formed at a lowermost part of the concave surface of the concave ceiling wall.

4. The head cover according to claim 1, wherein the recessed groove is formed at a lowermost part of the concave surface of the concave ceiling wall.

5. The head cover according to claim 1, wherein the recessed groove extends in a direction along a crankshaft of the internal combustion engine.

6. The head cover according to claim 5, wherein the ceiling wall is formed with a boss portion which defines an oil inlet and to which an oil filler cap can be detachably attached, and an oil trap portion that surrounds the boss portion and has a part formed with an oil discharge opening, wherein the recessed groove is connected to the oil trap portion at one end of the recessed groove.

7. The head cover according to claim 1, wherein grid-shaped ribs are formed on an inner surface of the concave ceiling wall.

* * * * *